US012624845B2

(12) United States Patent
Hattori et al.

(10) Patent No.: US 12,624,845 B2
(45) Date of Patent: May 12, 2026

(54) AIR CONDITIONER, METHOD FOR CONTROLLING AIR CONDITIONER, AND RECORDING MEDIUM

(71) Applicant: Mitsubishi Electric Corporation, Tokyo (JP)

(72) Inventors: Hironori Hattori, Chiyoda-ku (JP); Kojiro Motomura, Chiyoda-ku (JP); Takashi Kobayashi, Chiyoda-ku (JP); Takuya Kodama, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 200 days.

(21) Appl. No.: 18/577,802

(22) PCT Filed: Sep. 24, 2021

(86) PCT No.: PCT/JP2021/035091
§ 371 (c)(1),
(2) Date: Jan. 9, 2024

(87) PCT Pub. No.: WO2023/047534
PCT Pub. Date: Mar. 30, 2023

(65) Prior Publication Data

US 2024/0318837 A1 Sep. 26, 2024

(51) Int. Cl.
*F24F 1/0059* (2019.01)
*F24F 11/63* (2018.01)

(52) U.S. Cl.
CPC ..... *F24F 1/0059* (2013.01); *F24F 11/63* (2018.01)

(58) Field of Classification Search
CPC ..... F25B 2600/2513; F25B 2600/2501; F25B 2700/191; F25B 2700/193;
(Continued)

(56) References Cited

U.S. PATENT DOCUMENTS

2011/0083456 A1* 4/2011 Wakamoto ..... F25B 41/00 62/115
2014/0261714 A1* 9/2014 Burt ..... F24F 11/84 137/79

(Continued)

FOREIGN PATENT DOCUMENTS

EP 3312524 A1 4/2018
JP 2019020112 A 2/2019
WO 2016203624 A1 12/2016

OTHER PUBLICATIONS

Kiesbauer, J. Control valves for critical applications, Hydrocarbon Processing, Jun. 2021. [retrieved on Sep. 2, 2025] Retrieved from Internet < https://www.samson.de/document/w01040en.pdf> (Year: 2021).*

(Continued)

*Primary Examiner* — Elizabeth J Martin
*Assistant Examiner* — Keona Lauren Banks
(74) *Attorney, Agent, or Firm* — BUCHANAN, INGERSOLL & ROONEY PC

(57) ABSTRACT

In an air conditioner, a controller calculates a value of a pressure of a refrigerant when the refrigerant is a saturated liquid at a value of a temperature measured by a second sensor, calculates, based on a value of a pressure or a temperature measured by a third sensor, a value of a pressure at an outlet of an expansion valve, calculates a difference dP1 between a value of a pressure measured by a first sensor and the calculated value of the pressure of the saturated liquid and a difference dP2 between the calculated value of the pressure of the saturated liquid and the value of the pressure at the outlet of the expansion valve, and adjusts, based on a proportion of the calculated difference dP2 to the calculated difference dP1, a degree of opening of the expansion valve.

15 Claims, 12 Drawing Sheets

(58) Field of Classification Search
CPC ..... F25B 2700/195; F25B 2700/197; F25B 2700/1163; F25B 2700/21171; F25B 2700/1931; F25B 2400/0409; F25B 2400/0411; F25B 2400/0417; F25B 2313/031; F25B 40/02
See application file for complete search history.

(56) References Cited

U.S. PATENT DOCUMENTS

| | | | | |
|---|---|---|---|---|
| 2016/0138351 | A1* | 5/2016 | Dillard | E21B 33/128 175/25 |
| 2020/0141609 | A1 | 5/2020 | Nakagawa et al. | |
| 2020/0191430 | A1* | 6/2020 | Wang | F24F 13/24 |

OTHER PUBLICATIONS

International Search Report (PCT/ISA/210) with translation and Written Opinion mailed on Nov. 9, 2021, by the Japan Patent Office as the International Searching Authority for International Application No. PCT/JP2021/035091. (8 pages).

* cited by examiner

AIR CONDITIONER, METHOD FOR CONTROLLING AIR CONDITIONER, AND RECORDING MEDIUM

TECHNICAL FIELD

The present disclosure relates to an air conditioner, a method for controlling an air conditioner, and a program.

BACKGROUND ART

A known air conditioner includes an outdoor unit including a compressor, a condenser, and a supercooling device, and an indoor unit including an expansion valve and an evaporator. In such an air conditioner, the refrigerant may generate a sound when passing through a pipe connecting the condenser in the outdoor unit and an inlet of the expansion valve in the indoor unit. To reduce the sound, the air conditioner may include a controller that adjusts the degree of opening of the expansion valve based on output values from a temperature sensor that measures the temperature of the refrigerant or a pressure sensor that measures the pressure of the refrigerant.

For example, Patent Literature 1 describes an air conditioner including an outdoor unit, a supercooling device, and a controller. The outdoor unit includes a bypass pipe that diverts a portion of the refrigerant that has passed through a condenser, a bypass expansion valve located on the bypass pipe, and an outdoor expansion valve located on a pipe that guides, to an outlet of the outdoor unit, the remaining portion of the refrigerant undiverted to the bypass pipe. The supercooling device causes heat exchange between the refrigerant that has passed through the condenser but yet to be diverted to the bypass pipe and the refrigerant expanded by the bypass expansion valve. The controller increases the degree of opening of the bypass expansion valve until the temperature value of the refrigerant measured by a temperature sensor at the inlet of the outdoor expansion valve reaches below the saturated liquid temperature.

The air conditioner described in Patent Literature 1 includes an indoor unit including an indoor expansion valve that expands the remaining refrigerant undiverted to the bypass pipe. The controller increases the degree of opening of the outdoor expansion valve until the pressure value of the refrigerant measured by a pressure sensor at the inlet of the indoor expansion valve reaches above the saturated liquid pressure.

Patent Literature 2 describes an air conditioner including an outdoor expansion valve located at the same position as the outdoor expansion valve described in Patent Literature 1. The air conditioner includes a controller that calculates a pressure loss of a pipe connecting the outlet of the outdoor unit to the inlet of the indoor unit based on output values from a first pressure sensor that measures the suction pressure of a compressor and a second pressure sensor that measures the ejection pressure of the compressor, and adjusts the degree of opening of the outdoor expansion valve based on the calculated pressure loss.

CITATION LIST

Patent Literature

Patent Literature 1: International Publication No. WO 2016/203624

Patent Literature 2: Unexamined Japanese Patent Application Publication No. 2019-20112

SUMMARY OF INVENTION

Technical Problem

The air conditioner described in Patent Literature 1 includes no sensor that measures the state of the refrigerant such as the temperature or the pressure upstream and downstream from the indoor expansion valve, and cannot accurately determine the state of the refrigerant upstream and downstream from the indoor expansion valve. The air conditioner may thus have difficulty in controlling the degrees of opening of the bypass expansion valve and the outdoor expansion valve precisely. This may not sufficiently reduce generation of a passage sound of the refrigerant passing through the indoor expansion valve.

The air conditioner described in Patent Literature 2 includes no sensor that measures the state of the refrigerant such as the temperature or the pressure upstream and downstream from the indoor expansion valve. The air conditioner thus may not sufficiently reduce generation of a passage sound of the refrigerant passing through the indoor expansion valve, as with the air conditioner described in Patent Literature 1.

In response to the above issue, an objective of the present disclosure is to provide an air conditioner, a method for controlling an air conditioner, and a program that can sufficiently reduce generation of a passage sound of a refrigerant passing through an expansion valve.

Solution to Problem

To achieve the above objective, an air conditioner according to an aspect of the present disclosure includes a refrigerant circuit, a first sensor, a second sensor, a third sensor, and a controller. The refrigerant circuit includes a compressor to compress a refrigerant, a condenser to condense the refrigerant ejected from the compressor, a supercooling device to supercool the refrigerant condensed by the condenser, an expansion valve to expand the refrigerant that has passed through the supercooling device, and an evaporator to evaporate the refrigerant expanded by the expansion valve. The first sensor measures a pressure of the refrigerant compressed by the compressor and yet to be expanded by the expansion valve. The second sensor measures a temperature of the refrigerant supercooled by the supercooling device and yet to be expanded by the expansion valve. The third sensor measures a pressure or a temperature of the refrigerant expanded by the expansion valve and yet to be compressed by the compressor. The controller calculates a value of a pressure of the refrigerant when the refrigerant is a saturated liquid at a value of the temperature measured by the second sensor, calculates, based on a value of the pressure or the temperature measured by the third sensor, a value of a pressure at an outlet of the expansion valve, calculates a difference $dP_1$ between a value of the pressure measured by the first sensor and the calculated value of the pressure of the saturated liquid and a difference $dP_2$ between the calculated value of the pressure of the saturated liquid and the value of the pressure at the outlet of the expansion valve, and adjusts, based on a proportion of the calculated difference $dP_2$ to the calculated difference $dP_1$, a degree of opening of the expansion valve.

Advantageous Effects of Invention

In the structure according to the above aspect of the present disclosure, the controller calculates the value of the pressure of the refrigerant when the refrigerant is a saturated liquid at the value of the temperature measured by the second sensor, calculates, based on the value of the pressure or the temperature measured by the third sensor, the value of the pressure at the outlet of the expansion valve, calculates the difference $dP_1$ between the value of the pressure measured by the first sensor and the calculated value of the pressure of the saturated liquid and the difference $dP_2$ between the calculated value of the pressure of the saturated liquid and the value of the pressure at the outlet of the expansion valve, and adjusts, based on the proportion of the difference $dP_2$ to the difference $dP_1$, the degree of opening of the expansion valve. This structure allows the refrigerant to be in a liquid state at the inlet of the expansion valve and to be in a gas-liquid two-phase at the outlet of the expansion valve and sufficiently reduces generation of a passage sound of the refrigerant passing through the expansion valve.

DESCRIPTION OF EMBODIMENTS

Figure 1:
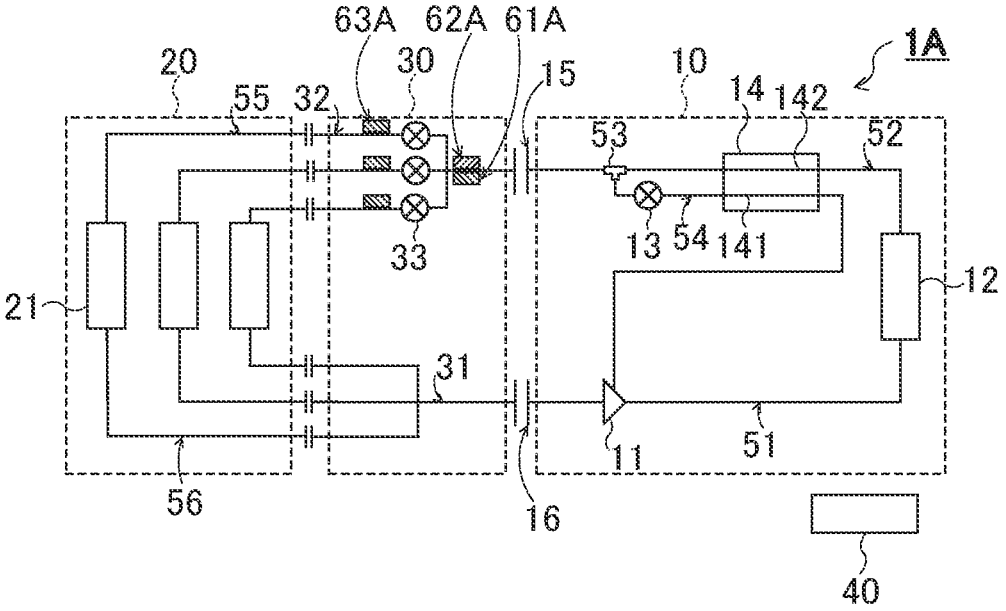
FIG. 1 is a diagram of a refrigerant circuit in an air conditioner according to Embodiment 1 of the present disclosure.

An air conditioner, a method for controlling an air conditioner, and a program according to one or more embodiments of the present disclosure are described below in detail with reference to the drawings. In the drawings, the same reference signs denote the same or corresponding components.

Embodiment 1

An air conditioner according to Embodiment 1 includes a controller to adjust the degree of opening of a bypass expansion valve to reduce a passage sound of a refrigerant passing through an indoor expansion valve. The air conditioner controlled by the controller is first described with reference to FIGS. 1 and 2.

FIG. 1 is a diagram of a refrigerant circuit in an air conditioner 1A according to Embodiment 1. For ease of understanding, a four-way valve is not illustrated in FIG. 1. The connection to a controller 40 is not illustrated.

As illustrated in FIG. 1, the air conditioner 1A includes an outdoor unit 10 installed outside a room to be air-conditioned, an indoor unit 20 installed in the room, a connector 30 connecting the outdoor unit 10 and the indoor unit 20, and a controller 40 that controls the operations of, for example, the outdoor unit 10 and the indoor unit 20.

The outdoor unit 10 is included in the air conditioner together with the indoor unit 20 and the connector 30. The air conditioner is as an example of a refrigeration cycle device in an aspect. The outdoor unit 10 includes a compressor 11 that compresses the refrigerant, an outdoor heat exchanger 12 that causes heat exchange between the refrigerant and air, a bypass expansion valve 13 installed on a bypass channel, and a supercooling device 14 that supercools the refrigerant with the heat exchanged by the outdoor heat exchanger 12.

The compressor 11 compresses the sucked low-pressure refrigerant into a high-pressure refrigerant. The compressor 11 is, for example, a rotary compressor or a scroll compressor.

The compressor 11 has a suction port through which the refrigerant is sucked and an exhaust port through which the compressed refrigerant is ejected. The suction port and the exhaust port of the compressor 11 are connected to a first port and a second port of a four-way valve (not illustrate).

The four-way valve (not illustrated) has, in addition to these ports, a third port connected to a connection pipe 31 included in the connector 30 and a fourth port connected to a refrigerant pipe 51 connected to the outdoor heat exchanger 12. The four-way valve is controlled by the controller 40 to switch the connection between the ports. The four-way valve thus switches the connection of the exhaust port of the compressor 11 between the connection to the connection pipe 31 in the connector 30 and the connection to the refrigerant pipe 51 connected to the outdoor heat exchanger 12. Thus, the four-way valve switches the direction of the refrigerant flow to switch the operation state of the air conditioner 1A between a cooling operation state and a heating operation state. The air conditioner 1A in the cooling operation state is hereafter referred to as being in a cooling operation.

When the air conditioner 1A is switched to the cooling operation state through switching of the four-way valve, the compressor 11 sucks the refrigerant in the connection pipe 31 in the connector 30 through the suction port, compresses the sucked refrigerant, and ejects the refrigerant to the refrigerant pipe 51 connected to the outdoor heat exchanger 12. The compressor 11 thus provides a high-pressure refrigerant to the outdoor heat exchanger 12.

The outdoor heat exchanger 12 is a finned tube heat exchanger, and causes heat exchange between the refrigerant and outdoor air around the outdoor unit 10.

More specifically, as described above, the outdoor heat exchanger 12 receives the high-pressure refrigerant from the compressor 11 in the cooling operation. The outdoor unit 10 includes a fan (not illustrated). The fan blows outdoor air to the outdoor heat exchanger 12. The outdoor heat exchanger 12 causes heat exchange between the high-pressure refrigerant provided by the compressor 11 and the outdoor air blown by the fan. The outdoor heat exchanger 12 thus condenses the refrigerant to function as a condenser.

The outdoor heat exchanger 12 is connected to a refrigerant pipe 52. The refrigerant condensed by the outdoor heat exchanger 12 flows into the refrigerant pipe 52.

A branch pipe 53 is installed along the refrigerant pipe 52 to direct a portion of the refrigerant to the supercooling device 14. The branch pipe 53 is connected to a bypass pipe 54 extending to the compressor 11 through the supercooling device 14. The bypass pipe 54 has the bypass expansion valve 13 and a heat-transfer pipe 141 included in the supercooling device 14 located along the bypass pipe 54 in this order in the direction from the branch pipe 53.

The bypass expansion valve 13 is an electronic expansion valve, and has the degree of opening controlled by the controller 40. As controlled by the controller 40, the bypass expansion valve 13 directs the refrigerant from the branch pipe 53 to the bypass pipe 54 in the cooling operation. The bypass expansion valve 13 also adjusts the flow rate of the refrigerant flowing through the bypass pipe 54. Thus, the bypass expansion valve 13 guides the decompressed refrigerant to the heat-transfer pipe 141 in the supercooling device 14 in the cooling operation.

The supercooling device 14 includes a heat-transfer pipe 142 along the refrigerant pipe 52 between the branch pipe 53 and the outdoor heat exchanger 12. The heat-transfer pipe 142 allows flow of the high-pressure refrigerant circulating through the refrigerant pipe 52 in the cooling operation. As described above, the supercooling device 14 includes the heat-transfer pipe 141 along the bypass pipe 54. The heat-transfer pipe 141 allows flow of a low-pressure refrigerant decompressed by the bypass expansion valve 13 in the cooling operation. In the supercooling device 14, the heat-transfer pipes 141 and 142 transfer heat to each other to exchange heat between the high-pressure refrigerant flowing through the heat-transfer pipe 142 and the low-pressure refrigerant flowing through the heat-transfer pipe 141. The supercooling device 14 thus cools the high-pressure refrigerant flowing through the heat-transfer pipe 142. A portion of the cooled refrigerant flows from the branch pipe 53 to the bypass pipe 54, and the remaining portion of the refrigerant flows into a connection port 15 in the outdoor unit 10 at the distal end of the refrigerant pipe 52. The connection port 15 is connected to the connector 30.

The connector 30 includes a connection pipe 32 that branches along the path from one end to the other end. The number of branches of the connection pipe 32 is the same as the number of indoor heat exchangers 21 included in the indoor unit 20. The connection pipe 32 has one end connected to the connection port 15 and the other branched ends connected to refrigerant pipes 55. The refrigerant pipes 55 are connected to the respective indoor heat exchangers 21 included in the indoor unit 20. The connection pipe 32 thus distributes the refrigerant flowing from the connection port 15 to the indoor heat exchangers 21 in the cooling operation.

The connector 30 includes indoor expansion valves 33 adjacent to the other branched ends of the connection pipe 32.

Similarly to the bypass expansion valve 13, the indoor expansion valves 33 are electronic expansion valves with the degree of opening controlled by the controller 40. When the refrigerant flows from the connection port 15 in the outdoor unit 10 in the cooling operation, the indoor expansion valves 33 expand and decompress the refrigerant as controlled by the controller 40. The indoor expansion valves 33 thus allow the decompressed refrigerant to flow to the refrigerant pipes 55 connected to the other branched ends of the connection pipe 32. The decompressed refrigerant is thus provided to the indoor heat exchangers 21.

Similarly to the outdoor heat exchanger 12, the indoor heat exchangers 21 are finned tube heat exchangers that cause heat exchange between the refrigerant and air in the room in which the indoor unit 20 is installed.

More specifically, the indoor heat exchangers 21 receive the decompressed refrigerant from the refrigerant pipes 55 in the cooling operation. The indoor heat exchangers 21 also receive the indoor air blown by a fan (not illustrated) included in the indoor unit 20. The indoor heat exchangers 21 then cause heat exchange between the refrigerant provided from the refrigerant pipes 55 and the indoor air blown by the fan and absorb heat from the indoor air to evaporate the refrigerant. The indoor heat exchangers 21 thus function as evaporators and cool the indoor air.

The indoor heat exchangers 21 are connected to refrigerant pipes 56. The refrigerant evaporated by the indoor heat exchangers 21 flows into the refrigerant pipes 56. The refrigerant pipes 56 extend to the connector 30 to be connected to the connection pipe 31 included in the connector 30. The refrigerant evaporated by the indoor heat exchangers 21 thus flows through the connection pipe 31.

The connection pipe 31 branches along the path from one end to the other end. The number of branches is the same as the number of indoor heat exchangers 21. The connection pipe 31 has one end connected to a connection port 16 in the outdoor unit 10 and the other branched ends connected to the refrigerant pipes 56. The connection pipe 31 thus merges the refrigerant from the refrigerant pipes 56 and allows the refrigerant to flow to the connection port 16 in the outdoor unit 10.

The connection port 16 is connected to the third port of the four-way valve (not illustrated) described above. The connection port 16 is thus connected to the suction port of the compressor 11 when the air conditioner 1A is switched to the cooling operation state through switching of the four-way valve. This allows the refrigerant to return to the compressor 11.

Figure 2:
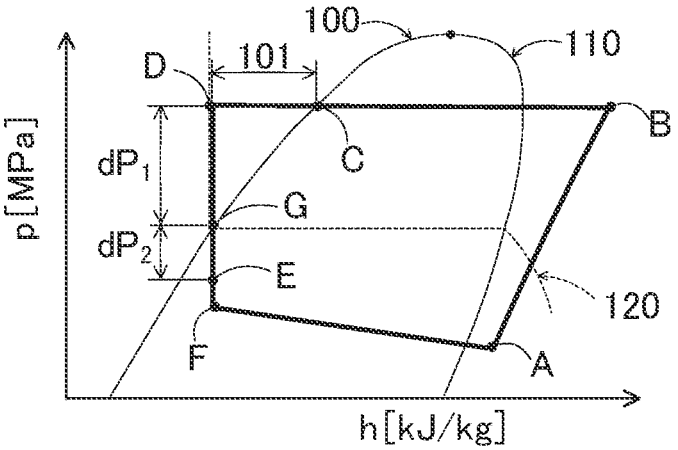
FIG. 2 is a pressure-enthalpy (p-h) chart illustrating the state of the refrigerant in the air conditioner according to Embodiment 1 of the present disclosure.

As described above, the air conditioner 1A performs the cooling operation to cool the indoor air through switching of the four-way valve. FIG. 2 illustrates the state of the refrigerant in this operation.

FIG. 2 is a pressure-enthalpy (p-h) chart illustrating the state of the refrigerant flowing through the air conditioner 1A. In FIG. 2, the horizontal axis indicates the enthalpy of the refrigerant, and the vertical axis indicates the refrigerant pressure. For ease of understanding, FIG. 2 includes a saturated liquid line 100 and a saturated vapor line 110.

The refrigerant is first compressed by the compressor 11 into a high-pressure, high-temperature gas as indicated by the line from point A to point B in FIG. 2. The refrigerant then flows into the outdoor heat exchanger 12. The refrigerant in the outdoor heat exchanger 12 is condensed to enter a gas-liquid two-phase from a gas state as indicated by the line from point B and point C in FIG. 2. Subsequently, the refrigerant flows into the supercooling device 14 and is supercooled by the supercooling device 14. The refrigerant thus enters a single liquid phase as indicated by the line from point C to point D in FIG. 2. The refrigerant in the single liquid phase flows into the indoor expansion valves 33 to enter a low-pressure gas-liquid two-phase as indicated by the line from point D to point E in FIG. 2. The refrigerant in the low-pressure gas-liquid two-phase then flows through the refrigerant pipes 55 from the indoor expansion valves 33 through the branched ends of the connection pipe 32. The refrigerant is further decompressed by the pressure loss corresponding to the length of the refrigerant pipes 55 as indicated by the line from point E to point F in FIG. 2. The decompressed refrigerant is thus provided to the indoor heat exchangers 21. In the indoor heat exchangers 21, the refrigerant in the gas-liquid two-phase exchanges heat with the indoor air to be decompressed into a refrigerant in a gas phase as indicated by the line from point F to point A in FIG. 2. The refrigerant then flows into the compressor 11.

The air conditioner 1A performs the cooling operation with this refrigeration cycle. In this refrigeration cycle, the supercooling device 14 supercools the refrigerant to enhance the refrigeration efficiency of the air conditioner 1A. However, when a supercooling degree 101 of the supercooling device 14 is too high, the refrigerant enters a single liquid phase at the indoor expansion valves 33 and generates a passage sound. When the supercooling degree 101 of the supercooling device 14 is too low, the refrigerant enters a gas-liquid two-phase at the indoor expansion valves 33 and generates a passage sound at the indoor expansion valves 33.

The air conditioner 1A thus uses the controller 40 to adjust the degree of opening of the bypass expansion valve 13 based on the state of the refrigerant upstream and downstream from the indoor expansion valves 33. The structure of the controller 40 is now described with reference to FIGS. 3 and 4, in addition to FIGS. 1 and 2.

Figure 3:
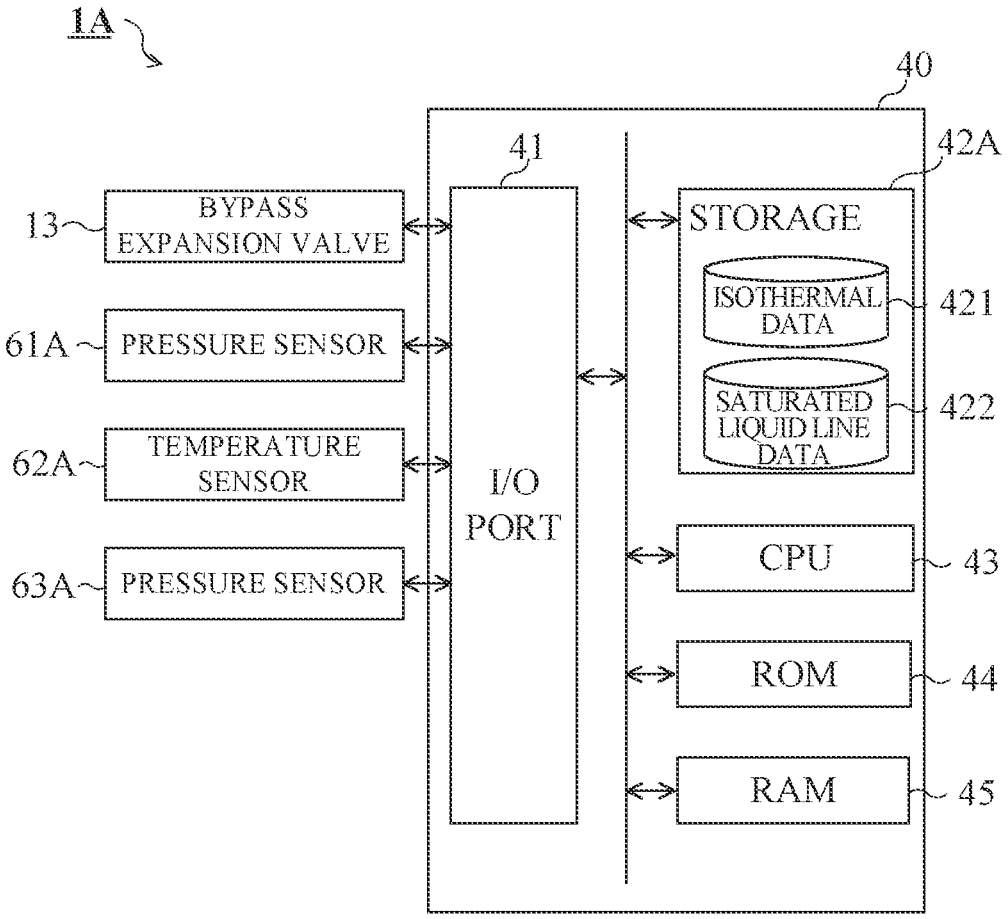
FIG. 3 is a diagram of a controller included in the air conditioner according to Embodiment 1 of the present disclosure, illustrating the hardware configuration.
Figure 4:
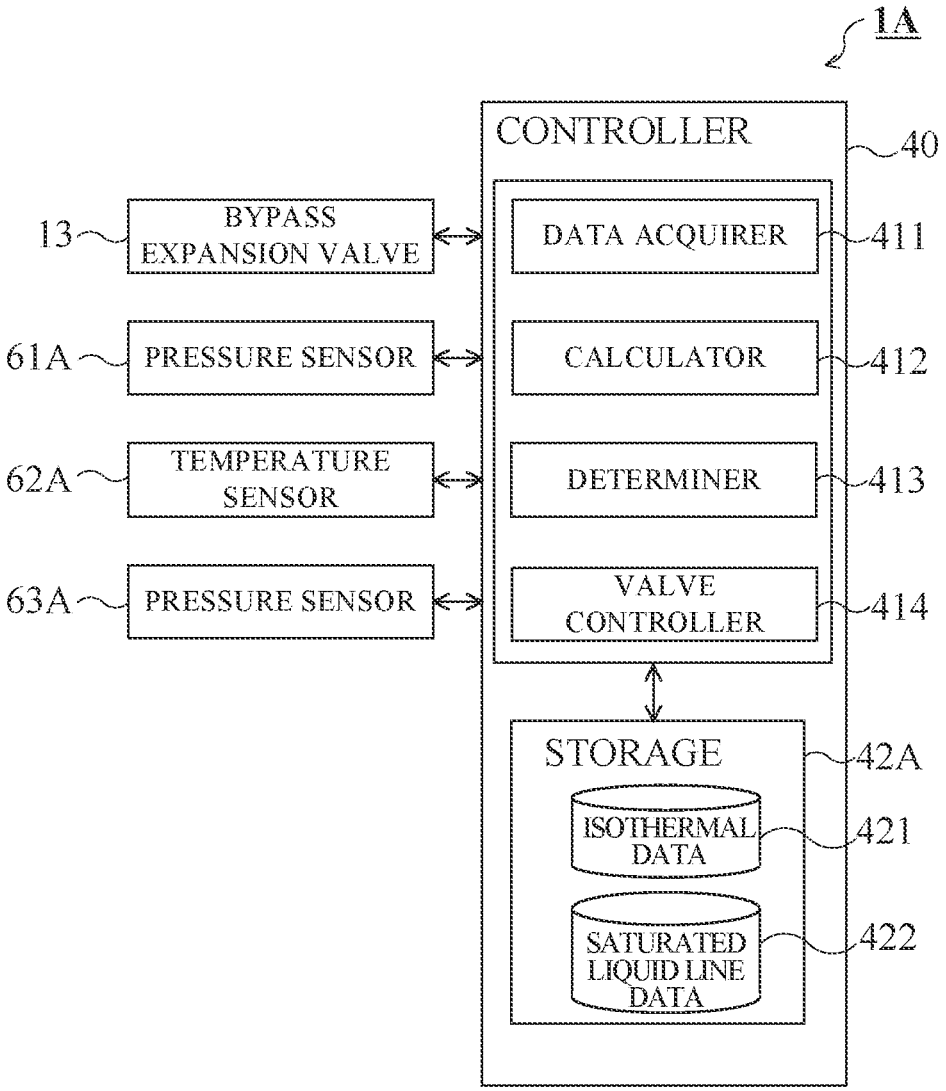
FIG. 4 is a block diagram of the controller included in the air conditioner according to Embodiment 1 of the present disclosure.

FIG. 3 is a diagram of the controller 40 included in the air conditioner 1A illustrating the hardware configuration. FIG. 4 is a block diagram of the controller 40 included in the air conditioner 1A. For ease of understanding, FIGS. 3 and 4 also illustrate components connected to the controller 40.

As illustrated in FIG. 3, the controller 40 includes an input-output (I/O) port 41 and a storage 42A.

The I/O port 41 is connected to a first sensor 61A, a second sensor 62A, and third sensors 63A. The first sensor 61A measures the pressure of the refrigerant before expanded by the indoor expansion valves 33 in the cooling operation. The second sensor 62A measures the temperature of the refrigerant before expanded by the indoor expansion valves 33 in the cooling operation. The third sensors 63A measure the pressure of the refrigerant after expanded by the indoor expansion valves 33 in the cooling operation.

The first sensor 61A is a pressure sensor that measures the pressure of the refrigerant. As illustrated in FIG. 1, the first sensor 61A is installed in a portion of the connection pipe 32 included in the connector 30 closer to the outdoor unit 10 than the indoor expansion valves 33. More specifically, the first sensor 61A is installed in a portion of the connection pipe 32 adjacent to the inlets of the indoor expansion valves 33. The first sensor 61A thus measures the pressure of the refrigerant flowing through the inlets of the indoor expansion valves 33.

The second sensor 62A is a temperature sensor that measures the temperature of the refrigerant. The second sensor 62A is installed in a portion of the connection pipe 32 adjacent to the inlets of the indoor expansion valves 33, similarly to the first sensor 61A. The second sensor 62A thus measures the temperature of the refrigerant flowing through the inlets of the indoor expansion valves 33.

The third sensors 63A are pressure sensors that measure the pressure of the refrigerant. The third sensors 63A are installed in portions of the connection pipe 32 included in the connector 30 closer to the indoor unit 20 than the indoor expansion valves 33. More specifically, the third sensors 63A are installed in portions of the connection pipe 32 adjacent to the outlets of the indoor expansion valves 33. The third sensors 63A thus measure the pressure of the refrigerant flowing through the outlets of the indoor expansion valves 33.

Referring back to FIG. 3, the first sensor 61A, the second sensor 62A, and the third sensors 63A transmit measurement data to a central processing unit (CPU) 43 through the I/O port 41.

The storage 42A includes, for example, an electrically erasable programmable read-only memory (EEPROM) or a flash memory. The storage 42A stores physical property data about the refrigerant flowing through the air conditioner 1A. More specifically, the storage 42A stores isothermal data 421 and saturated liquid line data 422 in the p-h chart of the refrigerant flowing through the air conditioner 1A.

The controller 40 includes a computer including the CPU 43, a read-only memory (ROM) 44, and a random-access memory (RAM) 45. The I/O port 41 is also electrically connected to the bypass expansion valve 13, in addition to the first sensor 61A, the second sensor 62A, and the third sensors 63A. Although not illustrated in FIG. 3, components in the air conditioner 1A such as the indoor expansion valves 33 and the compressor 11 are electrically connected to the I/O port 41. The controller 40 reads various programs stored in the storage 42A or the ROM 44 to the RAM 45 and executes the programs to perform various processes to control the components in the air conditioner 1A. For example, the controller 40 reads and executes a valve control program stored in the ROM 44 to perform a valve control process of controlling the degree of opening of the bypass expansion valve 13. To perform the valve control process, the controller 40 includes various blocks as software components illustrated in FIG. 4.

More specifically, the controller 40 includes a data acquirer 411 that acquires measurement data from the first sensor 61A, the second sensor 62A, and the third sensors 63A, a calculator 412 that calculates the value of a parameter K indicating the state of the refrigerant based on the measurement data acquired by the data acquirer 411, a determiner 413 that determines whether the value of the parameter K calculated by the calculator 412 is within a predetermined range, and a valve controller 414 that controls the degree of opening of the bypass expansion valve 13 based on the result of the determination.

The data acquirer 411 acquires measurement result data from the first sensor 61A, the second sensor 62A, and the third sensors 63A. The data acquirer 411 thus acquires data indicating the pressure and the temperature of the refrigerant at the positions of the sensors. More specifically, the data acquirer 411 acquires data indicating the pressure and the temperature of the refrigerant flowing through the inlets of the indoor expansion valves 33 and the pressure of the refrigerant flowing through the outlets of the indoor expansion valves 33. The data acquirer 411 transmits the acquired data to the calculator 412.

Upon receiving the data from the data acquirer 411, the calculator 412 reads the isothermal data 421 and the saturated liquid line data 422 from the storage 42A. The calculator 412 then calculates the pressure of the saturated liquid of the refrigerant at the temperature based on the temperature data about the refrigerant flowing through the inlets of the indoor expansion valves 33 received from the data acquirer 411 and the read isothermal data 421 and saturated liquid line data 422. The calculator 412 also calculates the value of the parameter K (described later in detail) based on the data indicating the pressure of the refrigerant flowing through the inlets of the indoor expansion valves 33 received from the data acquirer 411, the data indicating the pressure of the refrigerant flowing through the outlets of the indoor expansion valves 33 received from the data acquirer 411, and the calculated value of the pressure of the saturated liquid. The calculator 412 calculates the value of the parameter K, and transmits the calculated value to the determiner 413.

The determiner 413 determines whether the value of the parameter K calculated by the calculator 412 is within the predetermined range. More specifically, the determiner 413 determines whether the value of the parameter K is above or below the predetermined range and transmits the determination result to the valve controller 414.

The predetermined range is a numerical range indicating a distribution of values of the parameter K corresponding to reduced generation of a passage sound of the refrigerant.

When the determination result from the determiner 413 indicates that the value of the parameter K is out of the predetermined range, the valve controller 414 changes the degree of opening of the bypass expansion valve 13. More specifically, when the determination result indicates that the value of the parameter K is above the predetermined range, the valve controller 414 increases the degree of opening of the bypass expansion valve 13. When the determination result indicates that the value of the parameter K is below the predetermined range, the valve controller 414 decreases the degree of opening of the bypass expansion valve 13. When the value of the parameter K is within the predetermined range, the valve controller 414 maintains the degree of opening of the bypass expansion valve 13.

The controller 40 repeats the above series of operations of the data acquirer 411, the calculator 412, the determiner 413, and the valve controller 414 to maintain the value of the parameter K calculated by the calculator 412 within or closer to the predetermined range. The controller 40 thus allows the refrigerant in the single liquid phase to flow through the inlets of the indoor expansion valves 33 and the refrigerant in the gas-liquid two-phase to flow through the outlets of the indoor expansion valves 33. The controller 40 thus reduces generation or the volume of a passage sound of the refrigerant passing through the indoor expansion valves 33.

The operation of the controller 40 is now described with reference to FIGS. 5, 6, and 7A to 7C. In the example described below, the air conditioner 1A includes a power switch and an operation mode selection button (not illustrated) that are operable to activate the air conditioner 1A and select the cooling operation.

Figure 5:
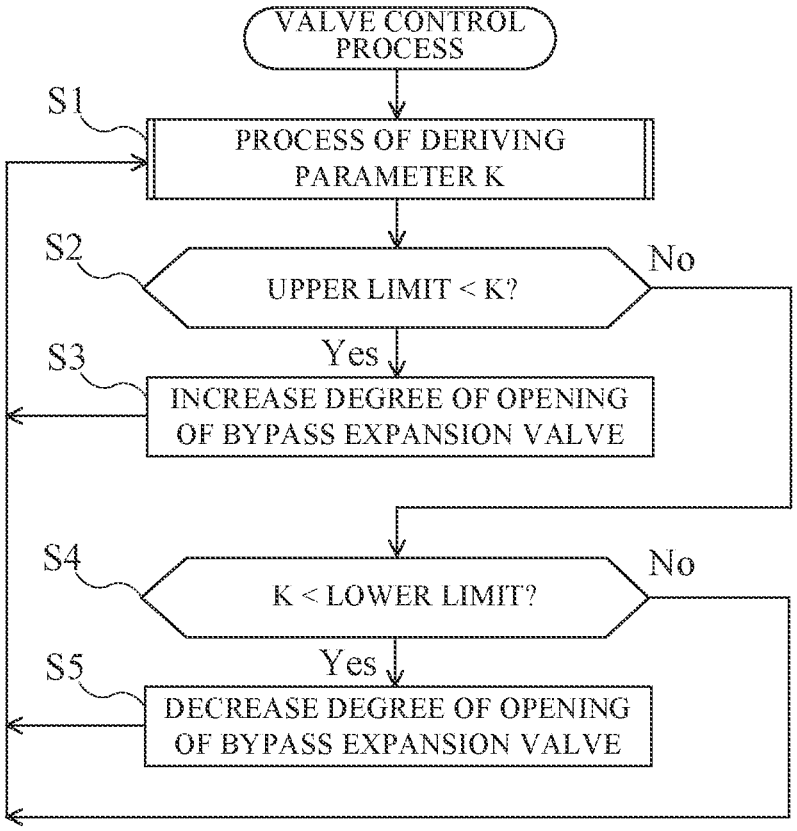
FIG. 5 is a flowchart of a valve control process performed by the controller included in the air conditioner according to Embodiment 1 of the present disclosure.
Figure 6:
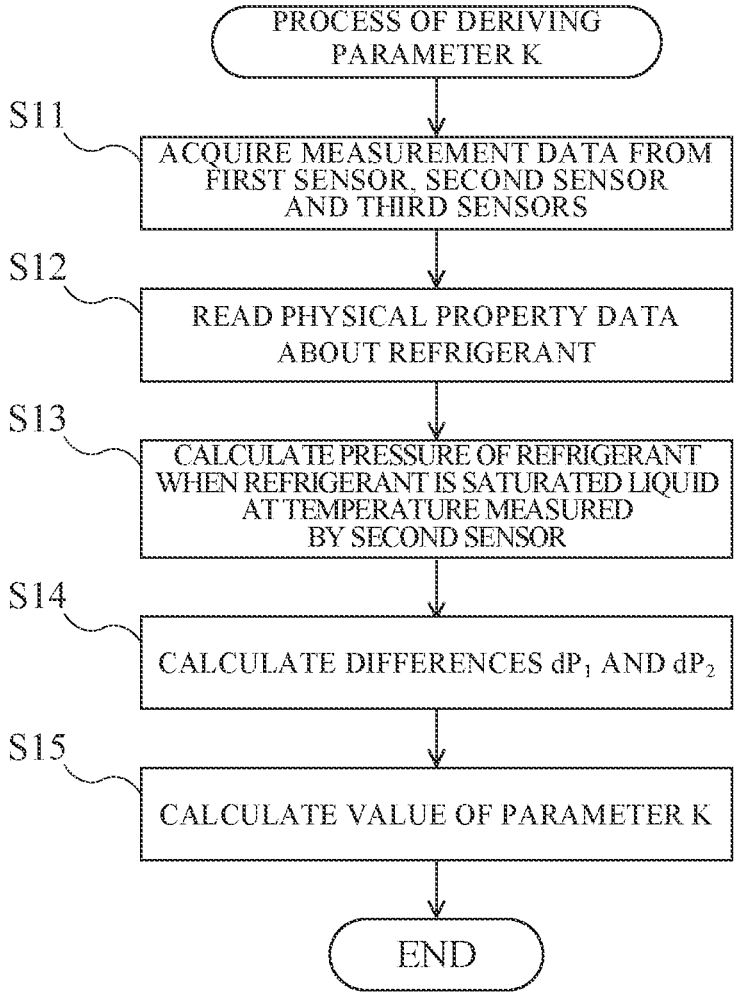
FIG. 6 is a flowchart of a process of deriving the value of a parameter K performed by the controller included in the air conditioner according to Embodiment 1 of the present disclosure.

FIG. 5 is a flowchart of a valve control process performed by the controller 40 included in the air conditioner 1A. FIG. 6 is a flowchart of a process of deriving the value of the parameter K performed by the controller 40.

When the power switch and the operation mode selection button (not illustrated) are pressed to activate the air conditioner 1A and select the cooling operation, the CPU 43 included in the controller 40 executes the valve control program to start the valve control process.

As illustrated in FIG. 5, the process of deriving the parameter K is first performed (step S1).

In the parameter-K deriving process, the controller 40 first acquires measurement data from the first sensor 61A, the second sensor 62A, and the third sensors 63A (step S11). More specifically, as described above, the first sensor 61A measures the pressure of the refrigerant flowing through the inlets of the indoor expansion valves 33. The second sensor 62A measures the temperature of the refrigerant flowing through the inlets. The third sensors 63A measure the pressure of the refrigerant flowing through the outlets of the indoor expansion valves 33. The controller 40 acquires, from the outputs from the first sensor 61A, the second sensor 62A, and the third sensors 63A, data indicating the pressure value and the temperature value of the refrigerant flowing through the inlets of the indoor expansion valves 33 and the pressure value of the refrigerant flowing through the outlets of the indoor expansion valves 33.

Upon acquiring the data, the controller 40 reads the physical property data about the refrigerant from the storage 42A (step S12). More specifically, the controller 40 reads the isothermal data 421 from the storage 42A, and reads the saturated liquid line data 422 as appropriate.

Subsequently, the controller 40 calculates, based on the temperature value measured by the second sensor 62A included in the acquired data and the read isothermal data 421, the pressure of the refrigerant when the refrigerant is a saturated liquid at the temperature measured by the second sensor 62A (step S13). For example, the controller 40 identifies the isothermal data at the temperature measured by the second sensor 62A from the read isothermal data 421 and calculates the pressure of the refrigerant when the refrigerant is a saturated liquid based on the critical point on an isotherm indicated by the isothermal data. More specifically, the controller 40 calculates the pressure value at point G illustrated in FIG. 2.

In some embodiments, the controller 40 may read the saturated liquid line data 422 from the storage 42A and calculate, based on the saturated liquid line data 422 and the isothermal data 421, the pressure of the refrigerant when the refrigerant is a saturated liquid at the temperature measured by the second sensor 62A.

Subsequently, the controller 40 calculates differences $dP_1$ and $dP_2$ (step S14). More specifically, the controller 40 calculates the difference $dP_1$ between the pressure value measured by the first sensor 61A included in the acquired data and the calculated pressure of the saturated liquid. The controller 40 also calculates the difference $dP_2$ between the calculated pressure of the saturated liquid and the pressure value measured by the third sensors 63A. This yields the pressure difference between points D and G in FIG. 2 and the pressure difference between points G and E. The differences $dP_1$ and $dP_2$ are calculated with reference to the saturated liquid pressure, and thus can be either a positive value or a negative value.

After calculating the differences $dP_1$ and $dP_2$, the controller 40 subsequently calculates the value of the parameter K expressed in Formula 1 (step S15).

$$K = \frac{(dP_1 + dP_2)}{dP_1} \quad (1)$$

Figure 7A:
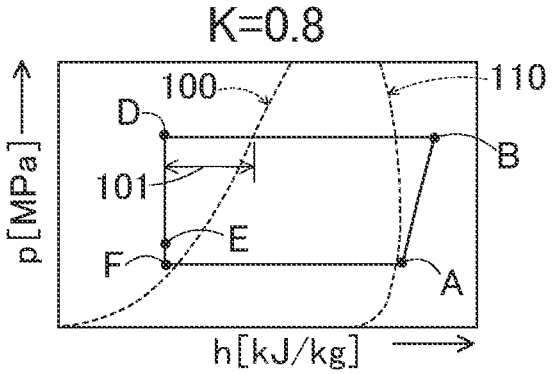
FIG. 7A is a p-h chart illustrating the state of the refrigerant when the value of a parameter K calculated by the controller included in the air conditioner according to Embodiment 1 of the present disclosure is 0.8.
Figure 7B:
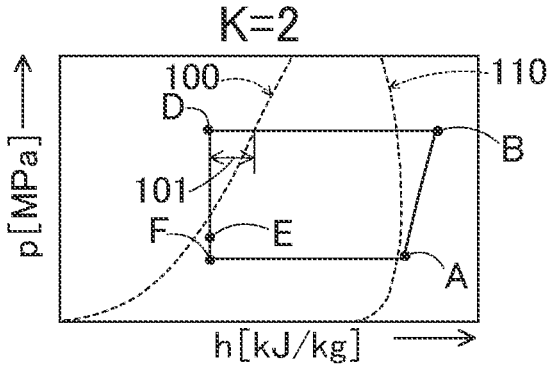
FIG. 7B is a p-h chart illustrating the state of the refrigerant when the value of the parameter K calculated by the controller included in the air conditioner according to Embodiment 1 of the present disclosure is 2.
Figure 7C:
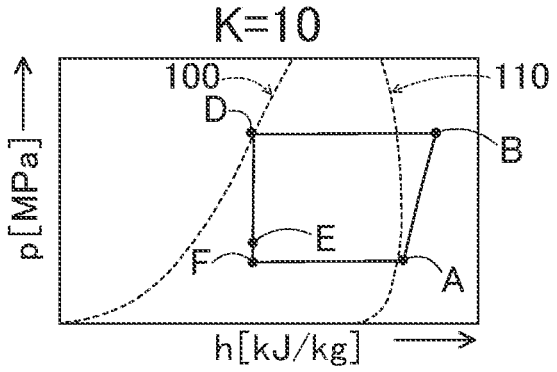
FIG. 7C is a p-h chart illustrating the state of the refrigerant when the value of the parameter K calculated by the controller included in the air conditioner according to Embodiment 1 of the present disclosure is 10.

The controller 40 uses the parameter K as an index for measuring the proportion of the difference $dP_2$ to the difference $dP_1$. More specifically, the pressure difference between points D and E in FIG. 2 indicates the pressure reduced by the indoor expansion valves 33. The parameter K is used as an index indicating the proportion of a portion of the refrigerant in the gas-liquid two-phase to the pressure reduced by the indoor expansion valves 33. The value of the parameter K is acquired to determine the state of the refrigerant before and after the refrigerant is decompressed by the indoor expansion valves 33. FIGS. 7A to 7C each illustrate an example relationship between the value of the parameter K and the state of the refrigerant.

FIG. 7A is a p-h chart illustrating the state of the refrigerant when the value of the parameter K calculated by the controller 40 is 0.8. FIG. 7B is a p-h chart illustrating the state of the refrigerant when the value of the parameter K is 2. FIG. 7C is a p-h chart illustrating the state of the refrigerant when the value of the parameter K is 10.

As illustrated in FIG. 7A, when the value of the parameter K is too low, point E indicating the state of the refrigerant after decompressed by the indoor expansion valves 33 is higher than the saturated liquid line 100, and thus the refrigerant is in a single liquid phase before and after decompressed by the indoor expansion valves 33. The refrigerant thus generates a sound when passing through the indoor expansion valves 33.

As illustrated in FIG. 7C, when the value of the parameter K is too high, point D indicating the state of the refrigerant before decompressed by the indoor expansion valves 33 is lower than the saturated liquid line 100, and thus the refrigerant is in the gas-liquid two-phase before and after decompressed by the indoor expansion valves 33. The refrigerant thus generates a sound when passing through the indoor expansion valves 33.

In contrast, as illustrated in FIG. 7B, when the value of the parameter K is appropriate, point D is higher than the pressure saturated liquid line 100 and point E is lower than the saturated liquid line 100. The refrigerant is thus in the single liquid phase before decompressed by the indoor expansion valves 33 and in the gas-liquid two-phase after decompressed by the indoor expansion valves 33. This reduces a passage sound of the refrigerant.

Such a relationship between the parameter K and the passage sound of the refrigerant indicates that the parameter K is preferably within the predetermined range. Additionally, the supercooling degree 101 being too high or too low can cause the value of the parameter K to deviate from the predetermined range. The controller 40 thus ends the process of deriving the parameter K after calculating the value of the parameter K in step S15 in FIG. 6, and returns to the valve control process illustrated in FIG. 5 to determine whether the value of the parameter K is within the predetermined range. The controller 40 adjusts the degree of opening of the bypass expansion valve 13 based on the determination result.

As illustrated in FIG. 5, subsequently to the process of deriving the parameter K in step S1, the controller 40 determines whether the value of the parameter K is greater than the upper limit (step S2). The upper limit in this determination refers to the K value less than, by a safety factor, the maximum K value determined to reduce a passage sound of the refrigerant based on experiments. For example, the upper limit is a K value that allows the supercooling degree of the refrigerant before decompressed by the indoor expansion valves 33 to be greater than 0. The safety factor herein refers to a ratio between the maximum value of the parameter K and an allowable maximum value of the parameter K corresponding to a passage sound of the refrigerant reduced to an allowable level. Being less than, by the safety factor, the maximum K value refers to being less than the maximum K value by the difference between the maximum value of the parameter K and the allowable maximum value of the parameter K.

When determining that the value of the parameter K is greater than the upper limit (Yes in step S2), the controller 40 increases the degree of opening of the bypass expansion valve 13 (step S3). For example, the controller 40 increases the degree of opening of the bypass expansion valve 13 by a predetermined value. In other words, the controller 40 opens the bypass expansion valve 13 by a predetermined degree. After step S3, the controller 40 returns to step S1 and performs the process of deriving the parameter K again.

When determining that the value of the parameter K is less than the upper limit (No in step S2), the controller 40 advances to step S4 to determine whether the value of the parameter K is less than a lower limit (step S4). The lower limit refers to a K value greater than, by a safety factor, the minimum value of the parameter K determined to reduce a passage sound of the refrigerant based on experiments. For example, the lower limit is a K value that allows the degree of dryness of the refrigerant decompressed by the indoor expansion valves 33 to be greater than 0. The safety factor herein refers to a ratio between the minimum value of the parameter K and an allowable minimum value of the parameter K corresponding to a passage sound of the refrigerant reduced to an allowable level. Being greater than, by a safety factor, the minimum K value refers to being greater than the minimum K value by the difference between the minimum value of the parameter K and the allowable minimum value of the parameter K.

When determining that the value of the parameter K is less than the lower limit (Yes in step S4), the controller 40 decreases the degree of opening of the bypass expansion valve 13 (step S5). For example, the controller 40 decreases the degree of opening of the bypass expansion valve 13 by a predetermined value. In other words, the controller 40 closes the bypass expansion valve 13 by a predetermined degree. As in step S3, after step S5, the controller 40 returns to step S1 and performs the process of deriving the parameter K again.

When determining that the value of the parameter K is greater than or equal to the lower limit (No in step S4), the controller 40 determines that the degree of opening of the bypass expansion valve 13 is appropriate and maintains the degree of opening of the bypass expansion valve 13. The controller 40 then returns to step S1, and repeats the processing in step S1 and subsequent steps.

When the user presses a power switch (not illustrated) to turn off the power or presses an operation mode selection button to switch the operation to a heating operation, the controller 40 forcibly ends the valve control process.

In the above embodiment, the controller 40 continues the valve control process after the air conditioner 1A is activated and the cooling operation is selected until the valve control process is terminated. In some embodiments, for example, the controller 40 may continue the valve control process for a predetermined period after the cooling operation is selected or after the air conditioner 1A is activated. In such a period, the refrigerant is highly likely to generate a passage sound.

Although the structure in the above embodiment includes three indoor heat exchangers 21, the air conditioner 1A may include at least one indoor heat exchangers 21. When the air conditioner 1A includes multiple indoor heat exchangers 21, the valve control process may be performed when any of the indoor heat exchangers 21 performs the cooling operation. In this case as well, the valve control process may be performed for a predetermined period after the start of the cooling operation.

As described above, in the air conditioner 1A according to Embodiment 1, the controller 40 calculates the pressure value of the refrigerant when the refrigerant is a saturated liquid at the temperature value measured by the second sensor 62A, calculates the difference $dP_1$ between the pressure value measured by the first sensor 61A and the calculated pressure value of the saturated liquid and the difference $dP_2$ between the calculated pressure value of the saturated liquid and the pressure value at the outlets of the indoor expansion valves 33 measured by the third sensors 63A, and adjusts the degree of opening of the bypass expansion valve 13 based on the proportion of the difference $dP_2$ to the difference $dP_1$. This allows the refrigerant to be in the liquid state at the inlets of the indoor expansion valves 33 and in the gas-liquid two-phase at the outlets of the indoor expansion valves 33 to sufficiently reduce generation of a passage sound of the refrigerant passing through the indoor expansion valves 33.

The bypass expansion valve 13 and the indoor expansion valves 33 described in Embodiment 1 are examples of expansion valves in an aspect of the present disclosure. The storage 42A is an example of a second storage in an aspect of the present disclosure. The indoor expansion valves 33 are examples of main expansion valves in an aspect of the present disclosure. The main expansion valves are not installed along a bypass channel defined by the bypass pipe 54 but along a main flow channel.

Embodiment 2

In Embodiment 1, the first sensor 61A measures the pressure of the refrigerant flowing through the inlets of the indoor expansion valves 33, and the second sensor 62A measures the temperature of the refrigerant flowing through the inlets of the indoor expansion valves 33. However, the first sensor 61A and the second sensor 62A are not limited to this example. The first sensor 61A may measure the pressure of the refrigerant compressed by the compressor 11 and yet to be expanded by the indoor expansion valves 33. The second sensor 62A may measure the temperature of the refrigerant diverted to the bypass pipe 54 and yet to be expanded by the indoor expansion valves 33.

Figure 8:
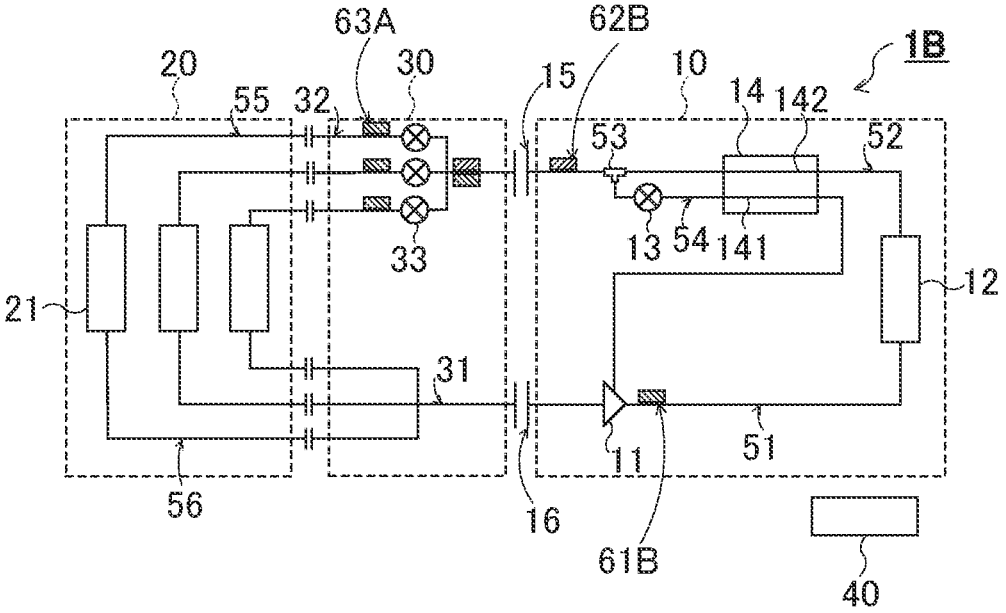
FIG. 8 is a diagram of a refrigerant circuit in an air conditioner according to Embodiment 2 of the present disclosure.

In an air conditioner 1B according to Embodiment 2, a first sensor 61B and a second sensor 62B are installed in the outdoor unit 10 instead of in the connector 30. With reference to FIG. 8, the air conditioner 1B according to Embodiment 2 is described below. In Embodiment 2, components different from the components in Embodiment 1 are mainly described.

FIG. 8 is a diagram of a refrigerant circuit in the air conditioner 1B according to Embodiment 2. As in FIG. 1, a four-way valve is not illustrated in FIG. 8.

As illustrated in FIG. 8, the first sensor 61B is located in a portion of the refrigerant pipe 51 included in the outdoor unit 10 near the exhaust port of the compressor 11. Similarly to the first sensor 61A, the first sensor 61B is a pressure sensor that measures the refrigerant pressure. The first sensor 61B thus measures the pressure of the refrigerant compressed by the compressor 11.

The second sensor 62B is installed at a distal end of the refrigerant pipe 52 included in the outdoor unit 10 near the connection port 15. Similarly to the second sensor 62A, the second sensor 62B is a temperature sensor that measures the refrigerant temperature. The second sensor 62B thus measures the temperature of the refrigerant with a portion diverted to the bypass pipe 54.

The first sensor 61B measures the refrigerant pressure at point B in FIG. 2 described in Embodiment 1. As clearly indicated in FIG. 2, the pressure measured by the first sensor 61B is the same as the refrigerant pressure at point D in FIG. 2 measured by the first sensor 61A in Embodiment 1. Although being spaced more distant from the inlets of the indoor expansion valves 33 than the second sensor 62A in Embodiment 1, the second sensor 62B measures the temperature of the refrigerant yet to be expanded by the indoor expansion valves 33. Thus, the values measured by the second sensor 62B have almost no difference from the values measured by the second sensor 62A in Embodiment 1 or substantially the same as the values measured by the second sensor 62A in Embodiment 1. Thus, the process of deriving the parameter K performed by the controller 40 is the same as the process in Embodiment 1, unless any measurement error occurs. The process of deriving the parameter K is not described. The valve control process is not described either.

As described above, in the air conditioner 1B according to Embodiment 2, the first sensor 61B and the second sensor 62B are installed in the outdoor unit 10. This structure can also sufficiently reduce generation of a passage sound of the refrigerant passing through the indoor expansion valves 33, as in the structure of Embodiment 1.

The exhaust port of the compressor 11 in Embodiment 2 is an example of an outlet of the compressor 11 in an aspect of the present disclosure.

Embodiment 3

In Embodiments 1 and 2, the third sensors 63A measure the pressure of the refrigerant flowing through the outlets of the indoor expansion valves 33. However, the third sensors 63A are not limited to this example. The third sensors 63A may measure the pressure of the refrigerant expanded by the indoor expansion valves 33 and yet to be compressed by the compressor 11.

Figure 9:
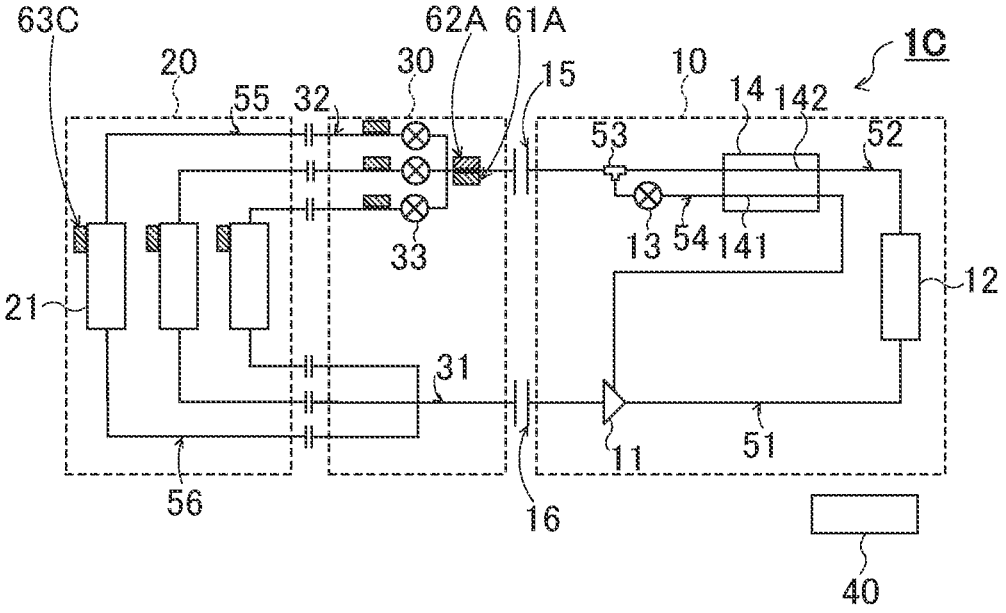
FIG. 9 is a diagram of a refrigerant circuit in an air conditioner according to Embodiment 3 of the present disclosure.
Figure 10:
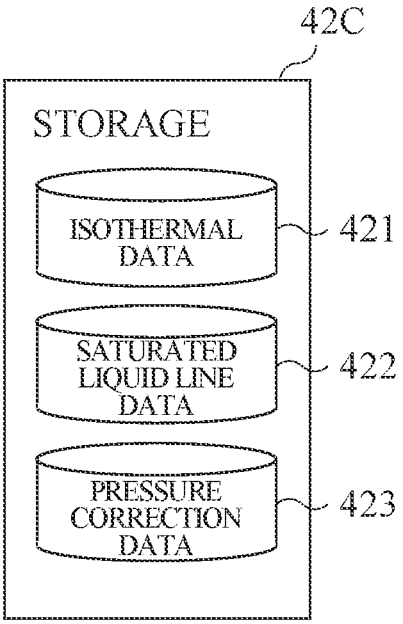
FIG. 10 is a block diagram of a storage included in the air conditioner according to Embodiment 3 of the present disclosure.

In an air conditioner 1C according to Embodiment 3, third sensors 63C are installed in the indoor unit 20, instead of in the connector 30. With reference to FIGS. 9 and 10, the air conditioner 1C according to Embodiment 3 is described below. In Embodiment 3, components different from the components in Embodiments 1 and 2 are mainly described.

FIG. 9 is a diagram of a refrigerant circuit in the air conditioner 1C according to Embodiment 3. FIG. 10 is a block diagram of a storage 42C included in the air conditioner 1C. As in FIGS. 1 and 8, a four-way valve is not illustrated in FIG. 9.

As illustrated in FIG. 9, the third sensors 63C are installed at the indoor heat exchangers 21 included in the indoor unit 20. Similarly to the third sensors 63A, the third sensors 63C are pressure sensors that measure the refrigerant pressure.

The third sensors 63C measure the pressure of the refrigerant flowing through the indoor heat exchangers 21.

The third sensors 63C measure the refrigerant pressure between points F and A in FIG. 2 described in Embodiment 1. As illustrated in FIG. 2, the refrigerant pressure between points F and A measured by the third sensors 63C is lower than the refrigerant pressure at point E measured by the third sensors 63A in Embodiment 1. The measurement values from the third sensors 63C are thus to be corrected to derive an accurate value of the parameter K.

To derive the value of the parameter K with a small error by compensating for the pressure difference, the air conditioner 1C includes the storage 42C to store pressure correction data 423 in addition to the isothermal data 421 and the saturated liquid line data 422.

The pressure correction data 423 is data indicating the pressure loss resulting from the displacement of the third sensors 63A from the installation positions in Embodiment 1 to the installation positions of the third sensors 63C in the present embodiment. More specifically, the pressure correction data 423 stored is data indicating a pressure value calculated by adding the pressure loss resulting from the lengths of pipes such as the connection pipe 32 and the refrigerant pipes 55 and the pressure loss from the inlets of the indoor heat exchangers 21 to the installation positions of the third sensors 63C in the present embodiment.

In the process of deriving the parameter K in step S11, the controller 40 acquires measurement data from the third sensors 63C instead of from the third sensors 63A as in Embodiment 1. In step S12, the controller 40 then reads the pressure correction data 423 from the storage 42C in addition to the isothermal data 421 and the saturated liquid line data 422. In step S14, the controller 40 adds the pressure value indicated by the read pressure correction data 423 to the pressure value measured by the third sensors 63C to calculate the pressure of the refrigerant flowing through the outlets of the indoor expansion valves 33. The controller 40 then subtracts the resulting refrigerant pressure at the outlets of the indoor expansion valves 33 from the pressure of the saturated liquid calculated in step S13 to calculate the difference $dP_2$. Thus, the controller 40 can acquire the value of the parameter K with a small error in step S15.

The controller 40 performs the valve control process described in Embodiment 1 to adjust the degree of opening of the bypass expansion valve 13.

As described above, in the air conditioner 1C according to Embodiment 3, the third sensors 63C are installed at the indoor heat exchangers 21, and the storage 42C stores the pressure correction data 423 based on the installation positions of the third sensors 63C. The controller 40 corrects the measurement values from the third sensors 63C based on the pressure correction data 423 to acquire the value of the parameter K with a small error. The air conditioner 1C can thus sufficiently reduce generation of a passage sound of the refrigerant passing through the indoor expansion valves 33 as in Embodiments 1 and 2.

The pressure correction data 423 described above is an example of correction data in an aspect of the present disclosure. The storage 42C is an example of a first storage in an aspect of the present disclosure.

Embodiment 4

In Embodiment 3, the third sensors 63C are installed at the indoor heat exchangers 21 to measure the refrigerant pressure. However, the third sensors 63C are not limited to this example. The third sensors 63C may measure the temperature of the refrigerant expanded by the indoor expansion valves 33 and yet to be compressed by the compressor 11.

Figure 11:
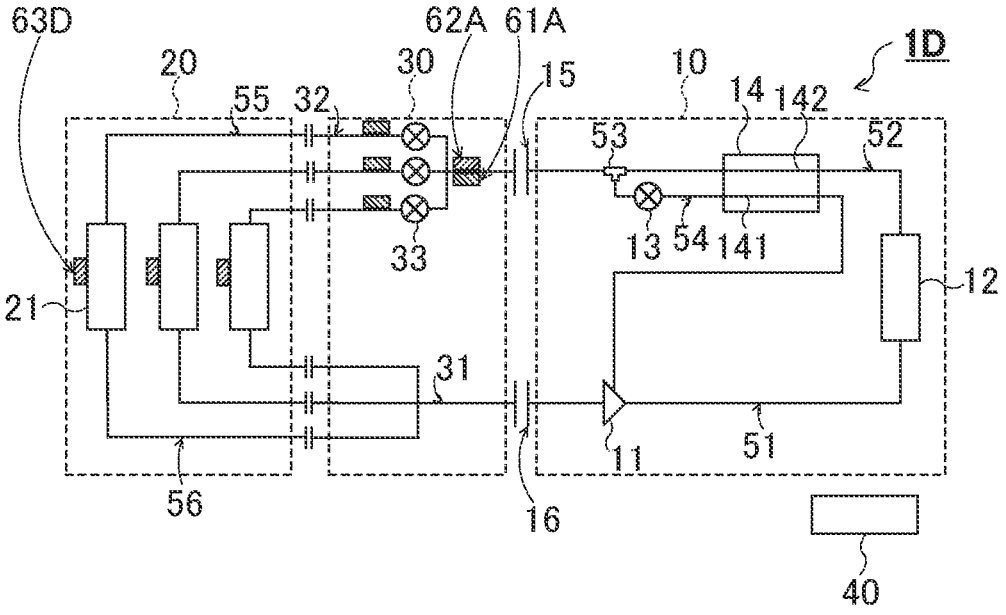
FIG. 11 is a diagram of a refrigerant circuit in an air conditioner according to Embodiment 4 of the present disclosure.

In an air conditioner 1D according to Embodiment 4, third sensors 63D are temperature sensors installed in the indoor unit 20. With reference to FIG. 11, the air conditioner 1D according to Embodiment 4 is described below. In Embodiment 4, components different from the components in Embodiments 1 to 3 are mainly described.

FIG. 11 is a diagram of a refrigerant circuit in the air conditioner 1D according to Embodiment 4. As in FIGS. 1, 8, and 9, a four-way valve is also not illustrated in FIG. 11.

As illustrated in FIG. 11, similarly to the third sensors 63C in Embodiment 3, the third sensors 63D are installed at the indoor heat exchangers 21. However, unlike the third sensors 63C in Embodiment 3, the third sensors 63D are temperature sensors that measure the refrigerant temperature. The third sensors 63D measure the temperature of the refrigerant flowing through the indoor heat exchangers 21.

The air conditioner 1D performs the process of deriving the parameter K in the same manner as in Embodiment 3 except for acquiring measurement data from the third sensors 63D instead of from the third sensors 63C in step S11, calculating, in step S14, the pressure of the refrigerant flowing through the indoor heat exchangers 21 based on the measurement data from the third sensors 63D, the isothermal data 421 read from the storage 42C, and the enthalpy of the refrigerant at the pressure of the saturated liquid calculated in step S13, and calculating the pressure of the refrigerant flowing through the outlets of the indoor expansion valves 33 by adding the pressure value indicated by the pressure correction data 423 described in Embodiment 3. The process of deriving the parameter K is not described in detail.

As described above, in the air conditioner 1D according to Embodiment 4, the third sensors 63D measure the temperature of the refrigerant flowing through the indoor heat exchangers 21. As in Embodiment 3, the air conditioner 1D also corrects the measurement values from the third sensors 63D based on the pressure correction data 423. Thus, the air conditioner 1D can acquire the value of the parameter K with a small error.

Embodiment 5

In Embodiments 1 to 4, the controller 40 calculates the value of the parameter K and adjusts the degree of opening of the bypass expansion valve 13 based on the value of the parameter K. However, the controller 40 is not limited to this example. The controller 40 may adjust the degree of opening of the indoor expansion valves 33 based on the parameter K.

In an air conditioner 1E according to Embodiment 5, the controller 40 adjusts the degree of opening of the indoor expansion valves 33. The air conditioner 1E according to Embodiment 5 is described below with reference to FIG. 12. In Embodiment 5, components different from the components in Embodiments 1 to 4 are mainly described.

Figure 12:
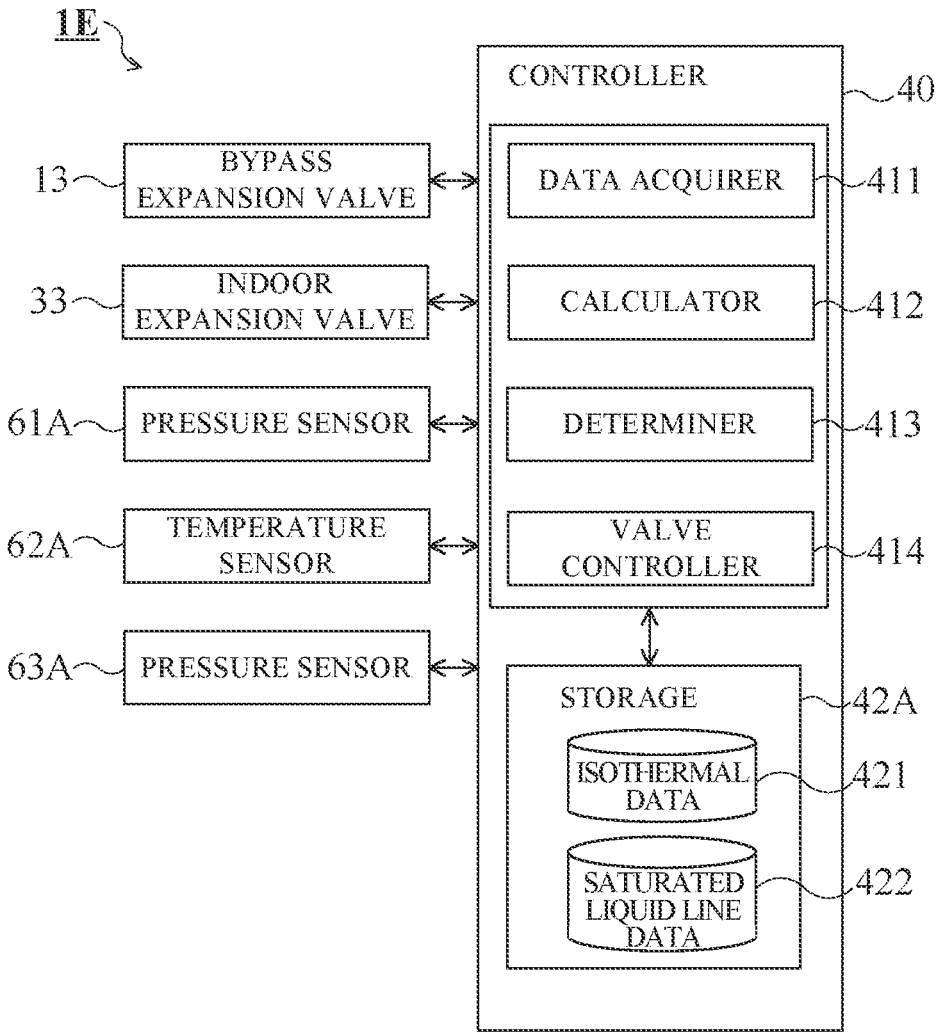
FIG. 12 is a block diagram of a controller included in an air conditioner according to Embodiment 5 of the present disclosure.

FIG. 12 is a block diagram of the controller 40 included in the air conditioner 1E according to Embodiment 5.

As illustrated in FIG. 12, the indoor expansion valves 33 are electrically connected to the controller 40. The valve controller 414 included in the controller 40 adjusts the degree of opening of the indoor expansion valves 33 instead of the degree of opening of the bypass expansion valve 13.

In step S3 of the valve control process described in Embodiment 1, the controller 40 decreases the degree of opening of the indoor expansion valves 33 instead of increasing the degree of opening of the bypass expansion valve 13. In step S5, the controller 40 increases the degree of opening of the indoor expansion valves 33 instead of decreasing the degree of opening of the bypass expansion valve 13. This reduces generation of a passage sound of the refrigerant passing through the indoor expansion valves 33 as in Embodiments 1 to 4.

In Embodiment 5, the valve controller 414 adjusts the degree of opening of the indoor expansion valves 33, but the valve controller 414 may also adjust the degree of opening of the bypass expansion valve 13 in addition to the degree of opening of the indoor expansion valves 33.

As described above, in the air conditioner 1E according to Embodiment 5, the degree of opening of the indoor expansion valves 33 is adjusted based on the value of the parameter K. The air conditioner 1E can thus sufficiently reduce generation of a passage sound of the refrigerant passing through the indoor expansion valves 33.

The bypass expansion valve 13 and the indoor expansion valves 33 described in Embodiment 5 are examples of expansion valves in an aspect of the present disclosure.

The air conditioners 1A to 1E according to the embodiments of the present disclosure, the methods for controlling the air conditioners 1A to 1E, and the program have been described as above, but are not limited to the examples described above.

In Embodiments 1 to 4, the supercooling device 14 supercools the refrigerant flowing from the outdoor heat exchanger 12 using the refrigerant diverted to the bypass pipe 54, and the bypass expansion valve 13 expands the refrigerant diverted to the bypass pipe 54. However, the supercooling device 14 is not limited to this example. The supercooling device 14 may be any device that supercools the refrigerant condensed by a condenser.

Figure 13:
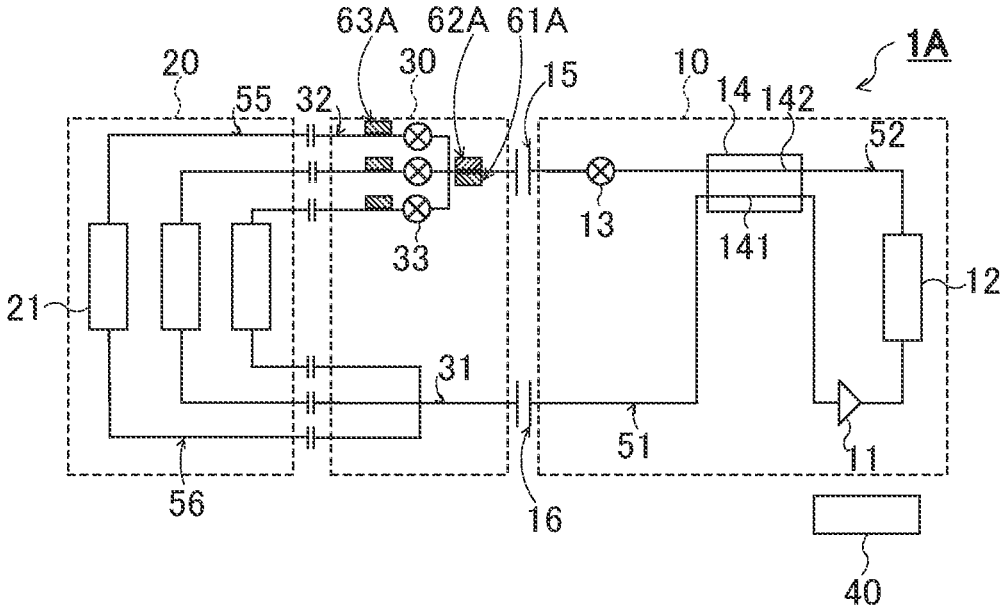
FIG. 13 is a circuit diagram of a refrigerant circuit in an air conditioner according to a modification of Embodiment 1 of the present disclosure.

FIG. 13 is a circuit diagram of a refrigerant circuit in the air conditioner 1A according to a modification of Embodiment 1.

As illustrated in FIG. 13, the supercooling device 14 may supercool the refrigerant that has passed through the outdoor heat exchanger 12 by causing heat exchange between the refrigerant that has passed through the outdoor heat exchanger 12 and the refrigerant yet to be compressed by the compressor 11, or more specifically, the refrigerant near the suction port of the compressor 11. In this case, the bypass expansion valve 13 may be eliminated. The controller 40 may adjust the degree of opening of the indoor expansion valves 33 based on the value of the parameter K.

In Embodiments 1 to 4, the controller 40 calculates the value of the parameter K expressed in Formula 1 and adjusts the degree of opening of the bypass expansion valve 13 or the degree of opening of the indoor expansion valves 33 based on the calculated value of the parameter K. However, the controller 40 is not limited to this example. The controller 40 may adjust the degree of opening of the bypass expansion valve 13 or the degree of opening of the indoor expansion valves 33 based on the proportion of the difference $dP_2$ to the difference $dP_1$. For example, the parameter K may be the ratio of the difference $dP_2$ to the difference $dP_1$, or in other words, $dP_2/dP_1$.

In Embodiments 1 to 4, the indoor expansion valves 33 are installed in the connector 30. However, the indoor expansion valves 33 are not limited to this example. The indoor expansion valves 33 may be any expansion valves that expand the refrigerant that has passed through the supercooling device 14, and may be simply referred to as expansion valves. For example, the indoor expansion valves 33 may be installed in the indoor unit 20. The indoor expansion valves 33 may be installed in the outdoor unit 10 and referred to as expansion valves.

In the above embodiments, the valve control program is stored in the ROM 44, but may be stored in a non-transitory computer-readable recording medium, such as a flexible disk, a compact disc read-only memory (CD-ROM), a digital versatile disc (DVD), or a magneto-optical (MO) disc, for distribution. The valve control program stored in the recording medium may be installed in a computer to implement the controller 40 that performs the valve control process.

The valve control program may be stored in a disk device included in a server on a communication network for the Internet, and may be, for example, superimposed on a carrier wave to be downloaded.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SIGNS LIST

1A to 1E Air conditioner
10 Outdoor unit
11 Compressor
12 Outdoor heat exchanger
13 Bypass expansion valve
14 Supercooling device
15, 16 Connection port
20 Indoor unit
21 Indoor heat exchanger
30 Connector
31, 32 Connection pipe
33 Indoor expansion valve
40 Controller
41 I/O port
42A, 42C Storage
43 CPU
44 ROM
45 RAM
51, 52 Refrigerant pipe
53 Branch pipe
54 Bypass pipe
55, 56 Refrigerant pipe
61A, 61B First sensor
62A, 62B Second sensor
63A, 63C, 63D Third sensor
100 Saturated liquid line
101 Supercooling degree
110 Saturated vapor line
141, 142 Heat-transfer pipe
411 Data acquirer
412 Calculator
413 Determiner
414 Valve controller
421 Isothermal data
422 Saturated liquid line data
423 Pressure correction data

The invention claimed is:

1. An air conditioner, comprising:

a refrigerant circuit including a compressor to compress a refrigerant, a condenser to condense the refrigerant ejected from the compressor, a supercooling device to supercool the refrigerant condensed by the condenser, an expansion valve to expand the refrigerant that has passed through the supercooling device, and an evaporator to evaporate the refrigerant expanded by the expansion valve;

a first sensor to measure a pressure of the refrigerant compressed by the compressor and yet to be expanded by the expansion valve;

a second sensor to measure a temperature of the refrigerant supercooled by the supercooling device and yet to be expanded by the expansion valve;

a third sensor to measure a pressure or a temperature of the refrigerant expanded by the expansion valve and yet to be compressed by the compressor; and a controlling circuitry configured to calculate a value of a pressure of the refrigerant when the refrigerant is a saturated liquid at a value of the temperature measured by the second sensor, to calculate, based on a value of the pressure or the temperature measured by the third sensor, a value of a pressure at an outlet of the expansion valve, to calculate a difference dP1 between a value of the pressure measured by the first sensor and the calculated value of the pressure of the saturated liquid and a difference dP2 between the calculated value of the pressure of the saturated liquid and the value of the pressure at the outlet of the expansion valve, and to adjust, based on a proportion of the calculated difference dP2 to the calculated difference dP1, a degree of opening of the expansion valve.

2. The air conditioner according to claim 1, wherein the refrigerant circuit further includes a bypass pipe to divert, to a suction port of the compressor, a portion of the refrigerant that has passed through the condenser, the expansion valve includes a bypass expansion valve and a main expansion valve, the bypass expansion valve being located on the bypass pipe and configured to expand the refrigerant, the main expansion valve being configured to receive a portion of the refrigerant that has passed through the condenser and undiverted to the bypass pipe and expand the undiverted portion of the refrigerant, the supercooling device supercools the refrigerant by causing heat exchange between the refrigerant that has passed through the condenser and yet to be diverted to the bypass pipe and the refrigerant expanded by the bypass expansion valve, and the controlling circuitry adjusts, based on the proportion of the calculated difference dP2 to the calculated difference dP1, a degree of opening of either one of the bypass expansion valve and the main expansion valve.

3. The air conditioner according to claim 2, wherein the controlling circuitry calculates a parameter K indicating the proportion of the difference dP2 to the difference dP1 using Formula 1 below:

$$K=(dP1+dP2)/dP1 \quad \text{Formula 1,}$$

the controlling circuitry determines, by determining whether a value of the calculated parameter K is within a numerical range indicating a distribution of values of the parameter K corresponding to reduced generation of a passage sound of the refrigerant, whether a passage sound of the refrigerant is generated, and the controlling circuitry adjusts the degree of opening of either one of the bypass expansion valve and the main expansion valve when determining that the value of the calculated parameter K is out of the numerical range and a passage sound of the refrigerant is yet to be reduced.

4. The air conditioner according to claim 3, wherein the controlling circuitry decreases the degree of opening of the bypass expansion valve when the calculated value of the parameter K is less than a lower limit of the numerical range, and increases the degree of opening of the bypass expansion valve when the calculated value of the parameter K is greater than an upper limit of the numerical range.

5. The air conditioner according to claim 3, wherein the controlling circuitry increases the degree of opening of the main expansion valve when the calculated value of the parameter K is less than a lower limit of the numerical range, and decreases the degree of opening of the main expansion valve when the calculated value of the parameter K is greater than an upper limit of the numerical range.

6. The air conditioner according to claim 2, wherein the refrigerant circuit includes a connector to allow a portion of the refrigerant excluding the portion diverted to the bypass pipe to flow through a connection pipe connected to the main expansion valve, and the second sensor is located in the connector.

7. The air conditioner according to claim 1, wherein the second sensor is located at an inlet of the expansion valve.

8. The air conditioner according to claim 1, wherein the first sensor is located at an outlet of the compressor or an inlet of the expansion valve.

9. The air conditioner according to claim 1, wherein the third sensor is located at the outlet of the expansion valve to measure a pressure of the refrigerant flowing through the outlet of the expansion valve.

10. The air conditioner according to claim 1, comprising:

a first storage to store correction data for correcting, based on an installation position of the third sensor, a measurement value of the third sensor, wherein the controlling circuitry calculates, based on the value of the pressure or the temperature measured by the third sensor and the correction data, the value of the pressure at the outlet of the expansion valve.

11. The air conditioner according to claim 10, wherein the third sensor is located at the evaporator to measure a pressure of the refrigerant flowing through the evaporator, the correction data is data, corresponding to a pressure loss of the refrigerant from the outlet of the expansion valve to the installation position of the third sensor at the evaporator, for correcting the measurement value of the third sensor, and the controlling circuitry calculates, based on the value of the pressure measured by the third sensor and the correction data, the value of the pressure at the outlet of the expansion valve.

12. The air conditioner according to claim 10, comprising:

a second storage to store physical property data about the refrigerant flowing through the refrigerant circuit, wherein the third sensor is installed at the evaporator to measure a temperature of the refrigerant flowing through the evaporator, the correction data is data, corresponding to a pressure loss of the refrigerant from the outlet of the expansion valve to the installation position of the third sensor at the evaporator, for correcting the measurement value of the third sensor, and the controlling circuitry calculates, using the value of the temperature measured by the third sensor and the physical property data, a value of a pressure of the refrigerant flowing through the installation position of the third sensor, and calculates, based on the calculated value of the pressure of the refrigerant and the correction data, the value of the pressure at the outlet of the expansion valve.

13. The air conditioner according to claim 1, comprising:

a storage to store physical property data about the refrigerant flowing through the refrigerant circuit, wherein the controlling circuitry calculates, using the physical property data, a value of a pressure of the refrigerant when the refrigerant is a saturated liquid at the value of the temperature measured by the second sensor, and calculates, based on the physical property data and the value of the pressure or the temperature measured by the third sensor, the value of the pressure at the outlet of the expansion valve.

14. A method for controlling an air conditioner, the air conditioner including a refrigerant circuit that includes a compressor to compress a refrigerant, a condenser to condense the refrigerant ejected from the compressor, a supercooling device to supercool the refrigerant condensed by the condenser, an expansion valve to expand the refrigerant that has passed through the supercooling device, and an evaporator to evaporate the refrigerant expanded by the expansion valve, the method comprising:

measuring a temperature of the refrigerant supercooled by the supercooling device and yet to be expanded by the expansion valve, and calculating a value of a pressure of the refrigerant when the refrigerant is a saturated liquid at a value of the measured temperature;

measuring a pressure or a temperature of the refrigerant expanded by the expansion valve and yet to be compressed by the compressor, and calculating, based on a value of the measured pressure or the measured temperature, a value of a pressure at an outlet of the expansion valve;

measuring a pressure of the refrigerant compressed by the compressor and yet to be expanded by the expansion valve, and calculating a difference dP1 between a value of the measured pressure and the value of the pressure of the saturated liquid and a difference dP2 between the value of the pressure of the saturated liquid and the value of the pressure at the outlet of the expansion valve; and adjusting, based on a proportion of the calculated difference dP2 to the calculated difference dP1, a degree of opening of the expansion valve.

15. A non-transitory recording medium storing a program configured to be executed by a computer configured to control an air conditioner, the air conditioner including a refrigerant circuit including a compressor to compress a refrigerant, a condenser to condense the refrigerant ejected from the compressor, a supercooling device to supercool the refrigerant condensed by the condenser, an expansion valve to expand the refrigerant that has passed through the supercooling device, and an evaporator to evaporate the refrigerant expanded by the expansion valve, a first sensor to measure a pressure of the refrigerant compressed by the compressor and yet to be expanded by the expansion valve, a second sensor to measure a temperature of the refrigerant supercooled by the supercooling device and yet to be expanded by the expansion valve, and a third sensor to measure a pressure or a temperature of the refrigerant expanded by the expansion valve and yet to be compressed by the compressor, the program causing the computer to perform operations comprising:

calculating a value of a pressure of the refrigerant when the refrigerant is a saturated liquid at a value of the temperature measured by the second sensor, calculating, based on a value of the pressure or the temperature measured by the third sensor, a value of a pressure at an outlet of the expansion valve, and calculating a difference dP1 between a value of the pressure measured by the first sensor and the value of the calculated pressure of the saturated liquid and a difference dP2 between the value of the calculated pressure of the saturated liquid and the value of the pressure at the outlet of the expansion valve; and adjusting, based on a proportion of the calculated difference dP2 to the calculated difference dP1, a degree of opening of the expansion valve.

* * * * *